US006354609B1

(12) United States Patent
Chen et al.

(10) Patent No.: US 6,354,609 B1
(45) Date of Patent: Mar. 12, 2002

(54) SKATE WITH SHORE FEATURE

(75) Inventors: Tzu-Nan Chen; Wen-Suei Chen, both of Tao Yuan (TW)

(73) Assignee: Wen Suei Chen (TW)

( * ) Notice: Subject to any disclaimer, the term of this patent is extended or adjusted under 35 U.S.C. 154(b) by 0 days.

(21) Appl. No.: 09/477,418

(22) Filed: Jan. 4, 2000

(51) Int. Cl.[7] ..... A63C 17/20

(52) U.S. Cl. ..... 280/11.3; 280/11.223; 280/11.19

(58) Field of Search ..... 280/11.19, 841, 280/11.223, 11.3; 36/115, 117.3; 301/5.3

(56) References Cited

U.S. PATENT DOCUMENTS 331,977 A * 12/1885 King ..... 280/841
3,306,623 A * 2/1967 Weitzner ..... 280/11.2
5,398,970 A * 3/1995 Tucky ..... 280/841
5,511,824 A * 4/1996 Kim ..... 280/841
5,601,342 A * 2/1997 Perner ..... 301/5.3
5,797,609 A * 8/1998 Fichepain ..... 280/11.19
5,800,022 A * 9/1998 Del Rosario ..... 301/5.3
5,845,913 A * 12/1998 Santarsiero ..... 280/11.19
6,105,976 A * 8/2000 Cottle ..... 280/11.2
6,120,039 A * 9/2000 Clementi ..... 280/11.19

* cited by examiner

*Primary Examiner*—J. J. Swann
*Assistant Examiner*—J. Allen Shriver
(74) *Attorney, Agent, or Firm*—Bacon & Thomas, PLLC

(57) ABSTRACT

A skate with shoe feature comprises two springs, two pairs of wheels each having a bore, two axles each having a length conformed to the distance between the pair of wheels, an axially groove, and an elongate pivot member hinged to the axially groove at one end, and a shoe body having two transverse tubes in the front and rear of the sole, and at least two curved fastening members on two sides in the axial direction of the pair of wheels. Whereby the compressed spring sleeved on the axle, one wheel sleeved on the axle, the axle through the bore, and the other wheel sleeved on the axle are secured together by pulling pivot member upwardly to make it perpendicular to axle.

1 Claim, 7 Drawing Sheets

SKATE WITH SHORE FEATURE

FIELD OF THE INVENTION

The present invention relates to a skate and more particularly to a skate shoe such that when mounted wheels are detached from skate by hands, the skate is a typical shoe.

BACKGROUND OF THE INVENTION

Conventionally, a skate is divided into two categories namely, a skate integrally formed with shoe, and skate and shoe formed separately. For the skate and shoe formed separately, it means user has to wear shoe first then fasten shoe to skate with clamps and straps prior to gliding on ice, sidewalk, etc. For the skate integrally formed with shoe, user simply wears shoe prior to gliding on ice, sidewalk, etc. But these are unsatisfactory for the purpose for which the invention is concerned for the following reason that for example, a user must carry another pair of skates when wears typical shoes to walk to field for skating. This is inconvenient and really bothers the user. Thus improvement exists.

SUMMARY OF THE INVENTION

It is thus an object of the present invention to provide a skate with shoe feature such that when mounted wheels are detached from skate by hands due to its simple components and easy assembly, the skate is a typical shoe thus eliminating the need to carry another pair of skates when user wears the skates with shoes feature of the invention to walk to field for skating.

The above and other objects, features and advantages of the present invention will become apparent from the following detailed description taken with the accompanying drawings.

DETAILED DESCRIPTION OF THE PREFERRED EMBODIMENTS

Figure 1:
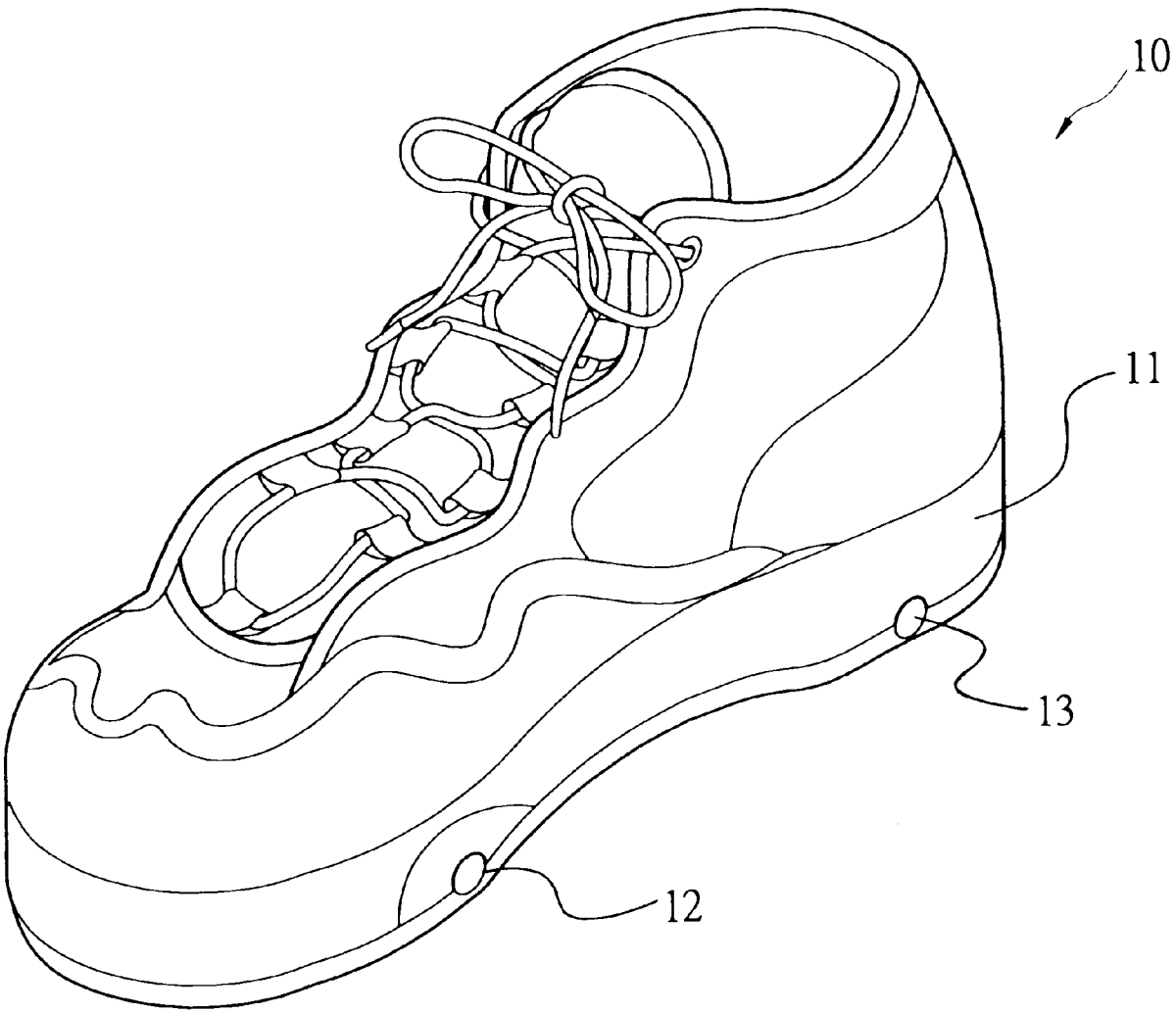
FIG. 1 is a perspective view of a first preferred embodiment of skate with shoe feature of the invention, where wheels are detached.
Figure 2:
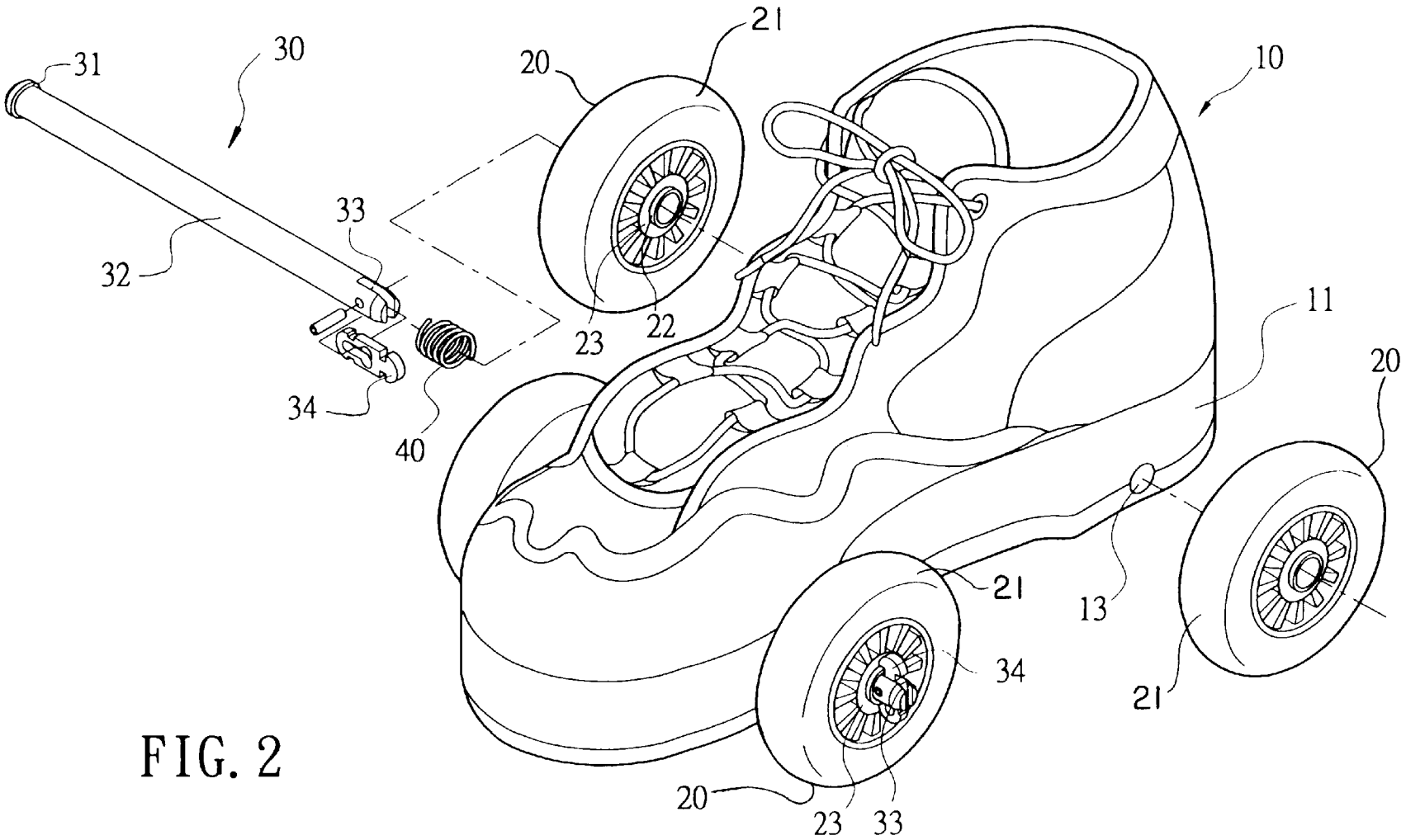
FIG. 2 is a perspective in partial exploded view of FIG. 1.
Figure 3:
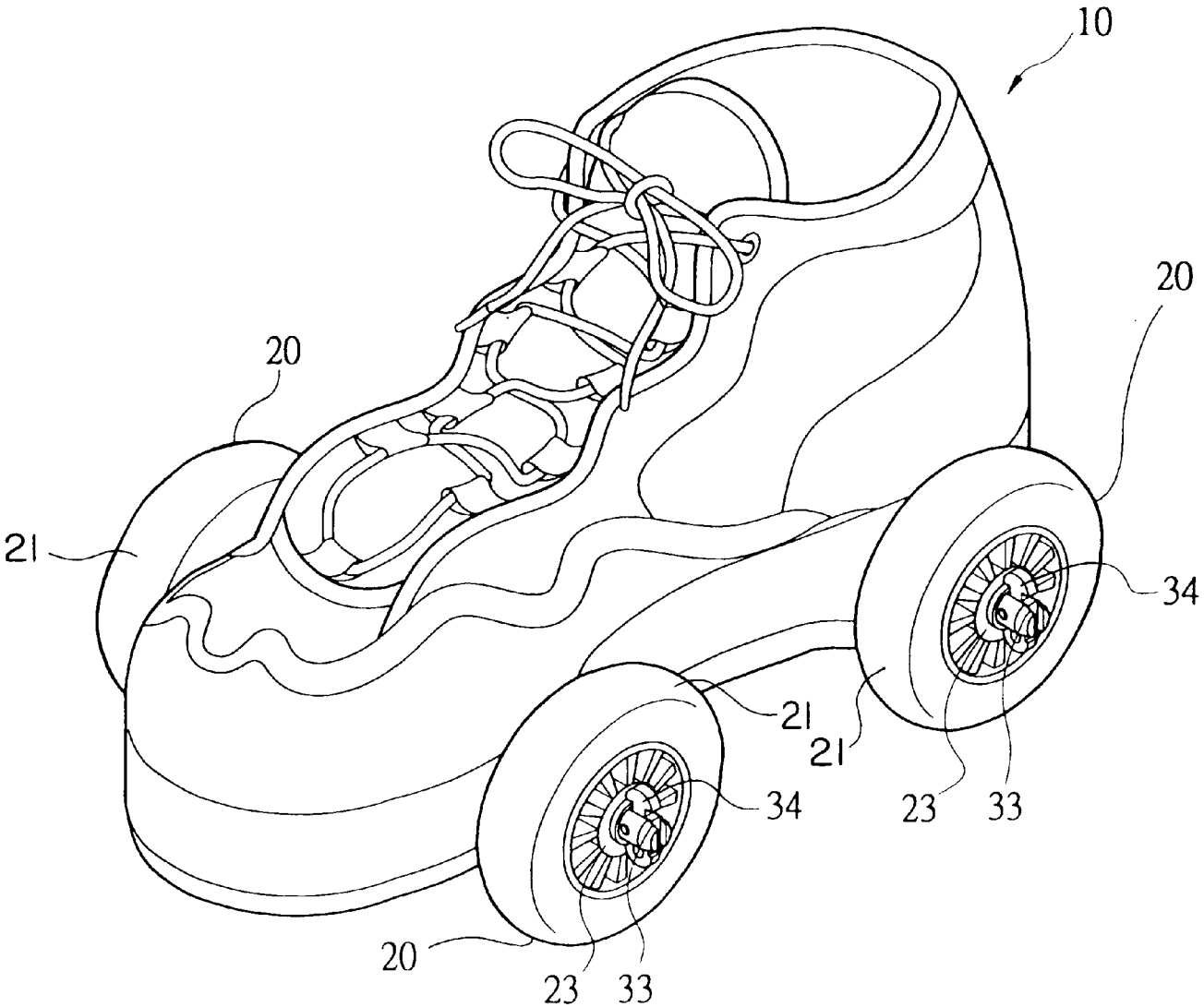
FIG. 3 is a perspective view of a first preferred embodiment of skate with shoe feature of the invention, where wheels are mounted.

Referring to FIGS. 1–3, there is shown a skate constructed in accordance with the invention comprising a shoe 10, four wheels 20, and two axles 30.

Two transverse through tubes 12, 13 are provided in the front and rear of sole 11 of shoe 10 respectively. Wheel 20 comprises a tire portion 21, a bearing 23 on the hub portion, and a bore 22 enclosed by bearing 23 wherein an extended enlarged portion is formed at either end of bore 22.

Axle 30 comprises an enlarged head 31 in one end, a bar 32 having a length conformed to the distance between two front (or rear) wheels 20, an axially groove 33 in the other end, and an elongate pivot member 34 having one transverse pin between two ends hinged to the two opposing sides of axially groove 33.

Figure 4A:
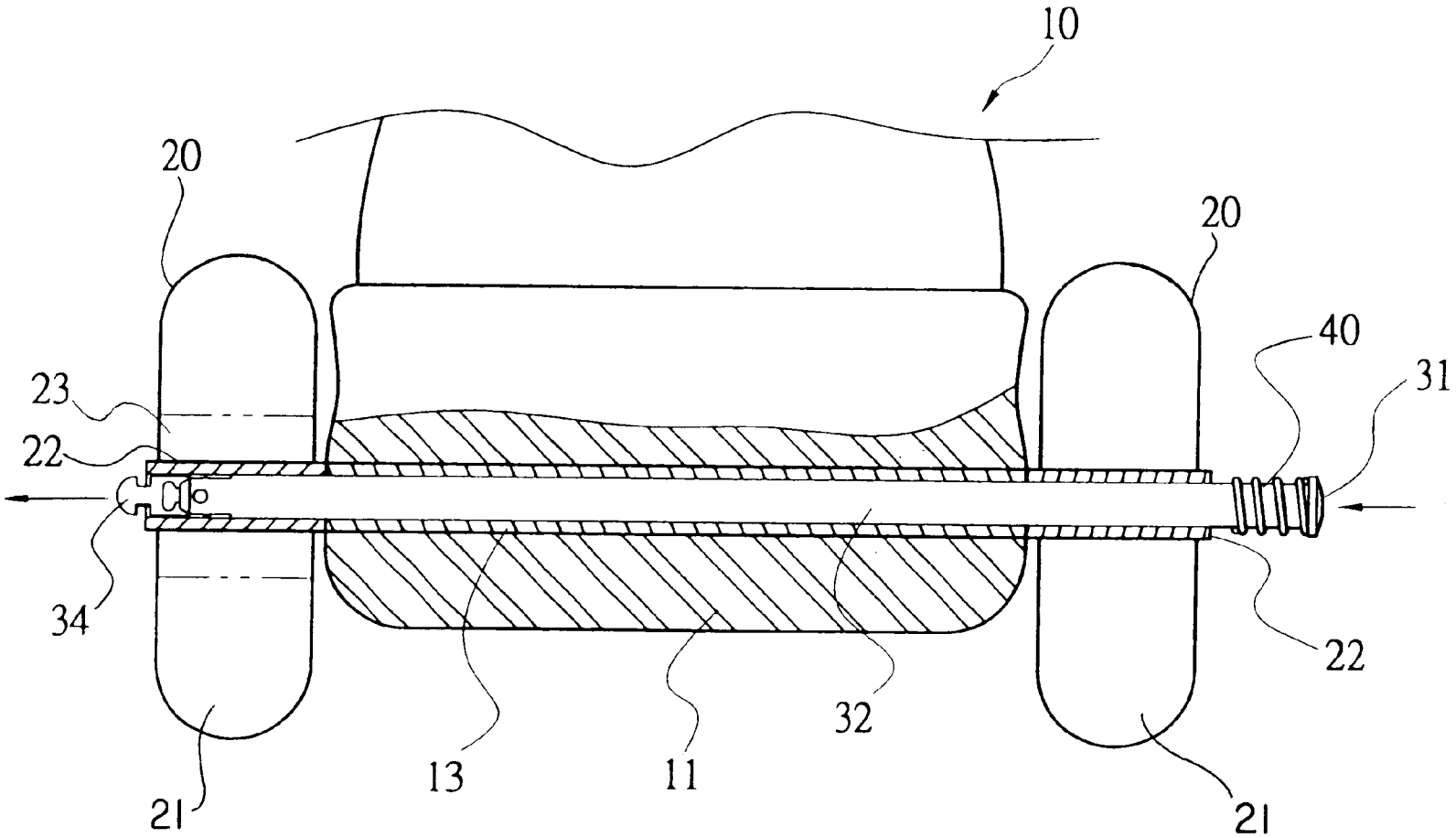
FIGS. 4A and 4B are rear views of FIG. 3 respectively showing the assembly of wheels on skate.
Figure 4B:
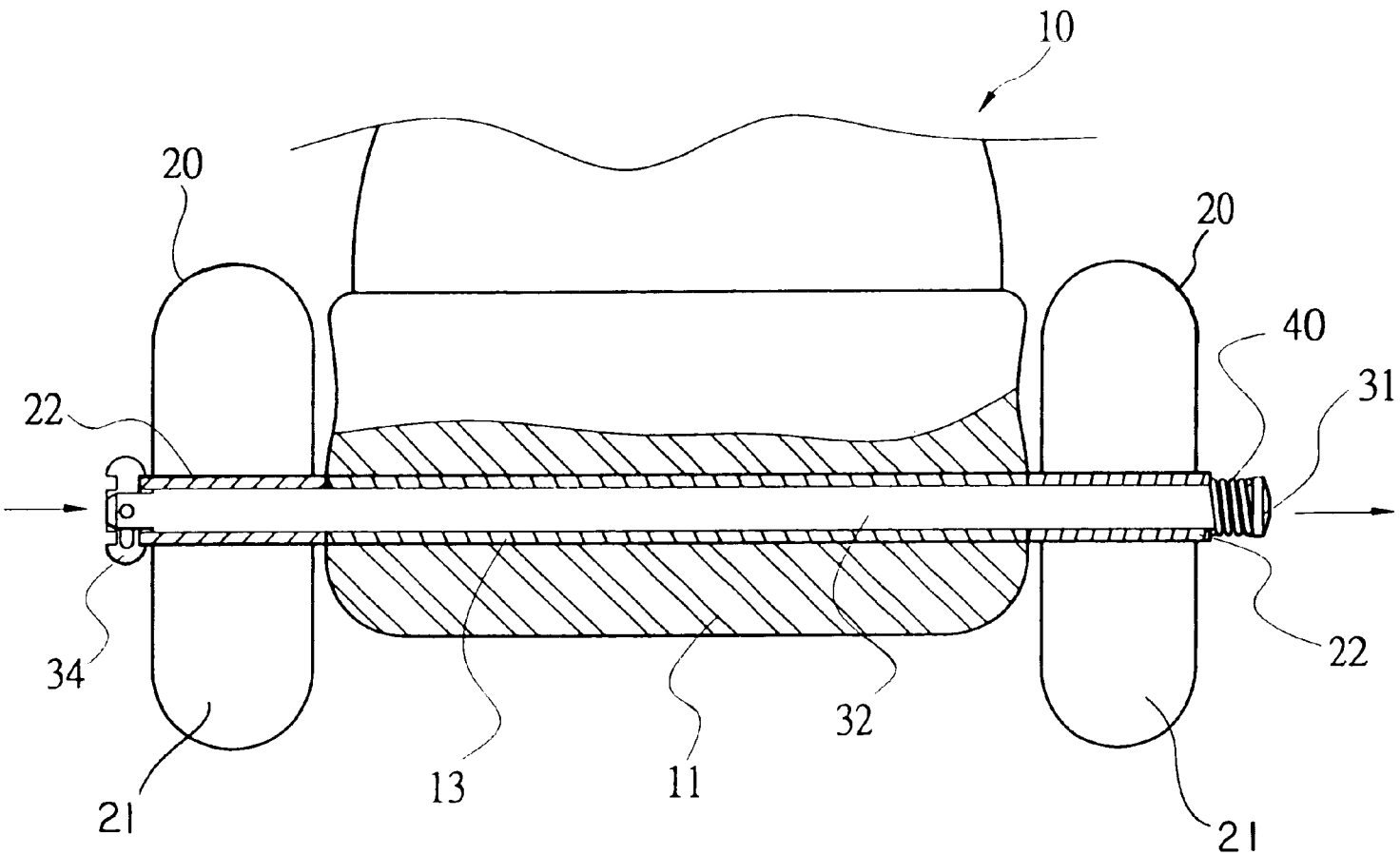

FIGS. 2, 4A, and 4B illustrate an assembly of the skate with shoe feature of the invention. Note that because the mounting of rear wheels 20 is an image of the mounting of front wheels 20 and thus description of the front wheels 20 serves to describe the entirety. First put a spring 40 and a wheel 20 on a bar 32 of axle 30 sequentially. Spring 40 is compressed between head 31 of axle 30 and one external end of bore 22 of wheel 20. Then insert bar 32 into and through the tube 12 in sole 11 (FIG. 2). As an end, the other internal end of bore 22 of wheel 20 is engaged with one external end of tube 12 (FIGS. 4A and 4B). Then put the other wheel 20 on bar 32. Press head 31 of axle 30 to compress spring 40 in order to see the whole pivot member 34 on the external end of the other wheel 20. As such, pull pivot member 34 upwardly to make it perpendicular to bar 32 (i.e., two ends of pivot member 34 are at either side of bare 32) and release the press on head 31. As a result, spring 40 is expanded which in turn causes front wheels 20 to secure to shoe 10 by the spring 40 and pivot member 34.

Figure 5:
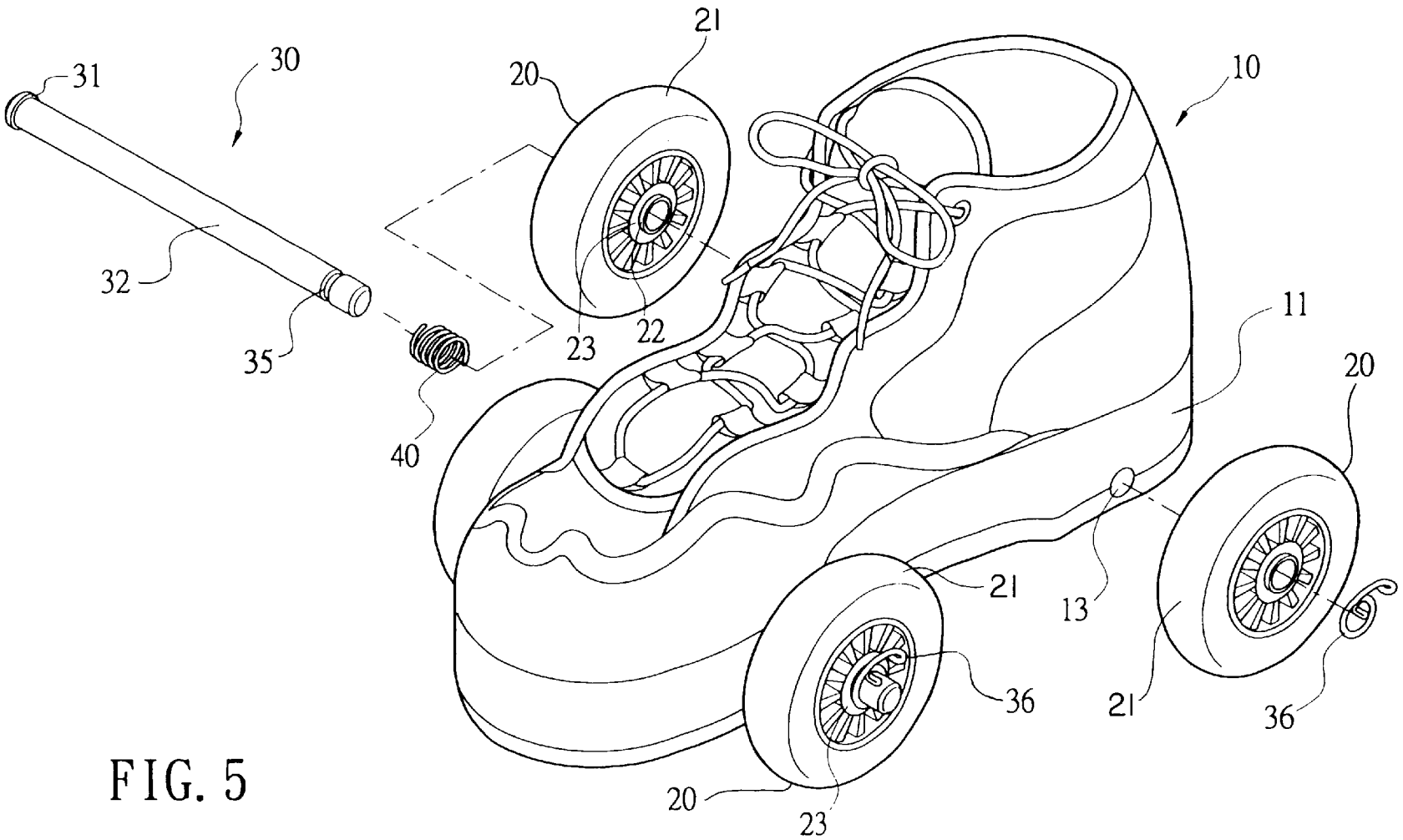
FIG. 5 is a perspective in partial exploded view of a second preferred embodiment of skate with shoe feature of the invention, where wheels being mounted.

FIG. 5 illustrates a second preferred embodiment of skate with shoe feature of the invention. This embodiment is generally the same as the first one except that a circumferential groove 35 is in replacement of the axially groove 33 and a C-shaped clamp 36 is in replacement of the pivot member 34 respectively. The assembly of skate with shoe feature of this embodiment is the same as the first embodiment, i.e., first put a spring 40 and a wheel 20 on bar 32 of axle 30 sequentially. Then insert bar 32 into and through the tube 12 in sole 11. Then put the other wheel 20 on bar 32. Press head 31 of axle 30 to compress spring 40 in order to see the whole circumferential groove 35 on the external end of the other wheel 20. The clamps 36 are expanded to fit in the circumferential grooves 35. As a result, spring 40 is expanded which in turn causes front wheels 20 to secure to shoe 10 by the spring 40 and circumferential groove 35.

Figure 6:
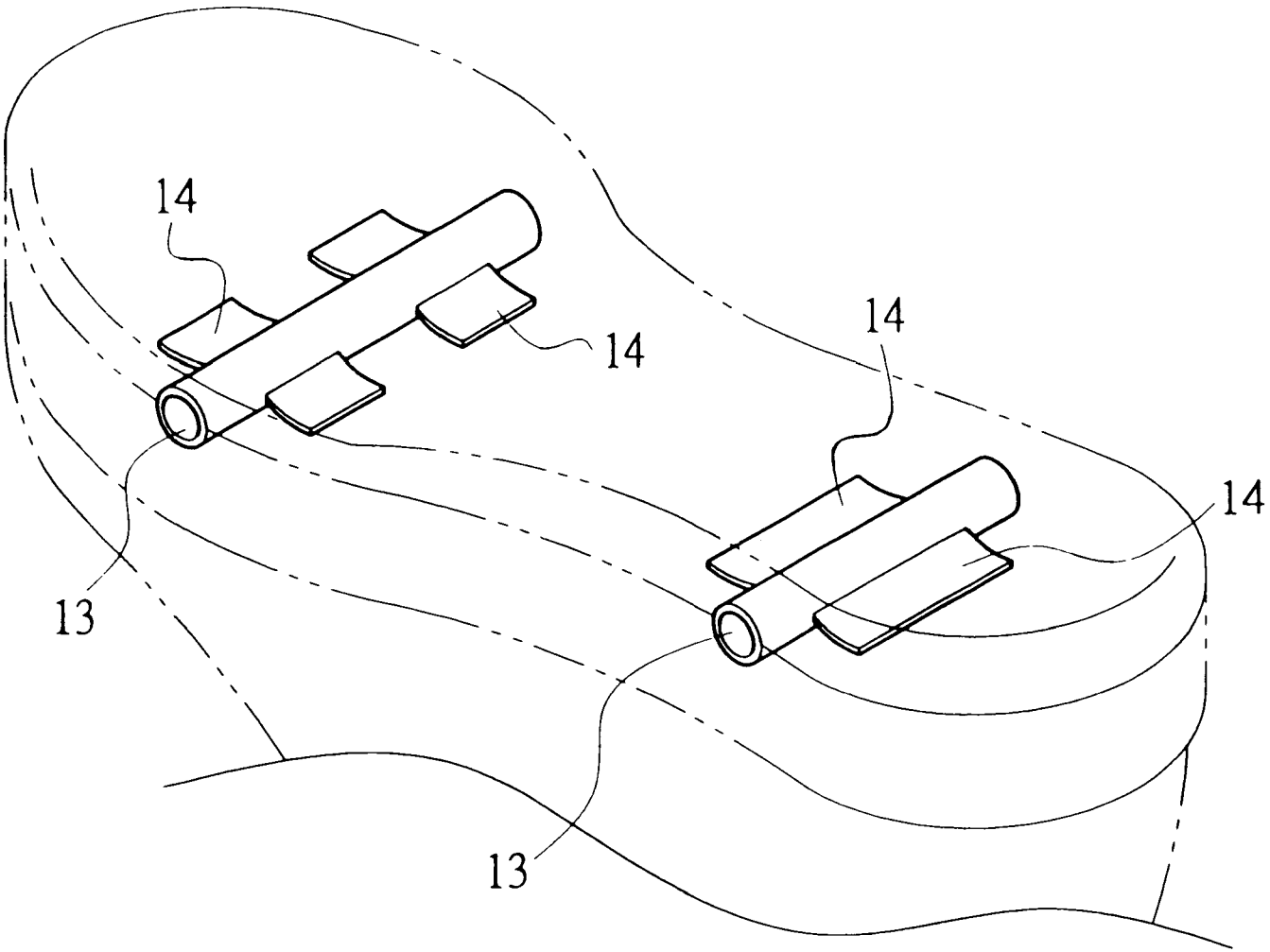
FIG. 6 is a bottom view schematically illustrating tubes through sole of the invention.

FIG. 6 illustrates the structure of tubes 12 and 13. As shown, at least two curved fastening members 14 are provided on two sides in the axial direction of wheel 12 or 13. As such, curved fastening members 14 may secure wheels 12 and 13 to sole 11 of shoe 10. Note that curved fastening member 14 is convex so as to provide a cushion between insole and outsole when user wears shoes 10 to walk. This is a comfortable design especially when sole is thin.

Advantages of the Invention

The skate with shoe feature is advantageous because when mounted wheels are detached from skate by hands due to its simple components and easy assembly, the skate is a typical shoe thus eliminating the need to carry another pair of skates when user wears the skates with shoes feature of the invention to walk to field for skating.

While the invention herein disclosed has been described by means of specific embodiments, numerous modifications and variations could be made thereto by those skilled in the art without departing from the scope and spirit of the invention set forth in the claims.

What is claimed is:

1. A shoe adapted for walking or skating, comprising:

a sole having first and second elongated bores extending therethrough and disposed in the forward and rearward portions thereof;

first and second removable axles each having an elongated shaft with an enlarged head at one end of said shaft, and having a tapered tip terminating at another end of said shaft, each of said axles forming an engagement recess that extends a distance from said another end into said shaft and a transverse throughhole extending through said shaft near said tapered tip and through a portion of said engagement recess, said first and second axles being disposed in said first and second bores, respectively;

first and second springs each being mounted onto said first and second axles respectively so as to communicate with said enlarged head of each of said axles;

said first and second axles having a wheel mounted at each end thereof, each wheel having a bore and an extended enlarged portion formed by the wheel along the periphery of said bore;

first and second pivot members each having first and second rounded ends, opposing transverse grooves located near each of said rounded ends and a T-shaped slot longitudinally formed along each pivot member;

first and second transverse pins for slidably securing said first and second pivot members, respectively, within a respective engagement recess of said first and second axles by being inserted into a respective transverse through hole of said first and second axles, wherein said first and second pivot members engage with said extended portion of said wheels mounted at said another end of said first and second axles so as to secure said wheels to said sole.

* * * * *